US007188646B2

(12) United States Patent
Fitzgerald

(10) Patent No.: US 7,188,646 B2
(45) Date of Patent: Mar. 13, 2007

(54) KIT TO FORM A WOOD SPLITTING APPARATUS

(76) Inventor: Lawrence Owen Fitzgerald, 511, 12831—66 Street, Edmonton, Alberta (CA) T5C 0A4

( * ) Notice: Subject to any disclaimer, the term of this patent is extended or adjusted under 35 U.S.C. 154(b) by 0 days.

(21) Appl. No.: 11/372,849

(22) Filed: Mar. 10, 2006

(65) Prior Publication Data

US 2006/0162815 A1 Jul. 27, 2006

Related U.S. Application Data

(62) Division of application No. 10/483,173, filed on Jan. 8, 2004, now Pat. No. 7,040,363, which is a division of application No. PCT/CA02/00719, filed on May 17, 2002.

(51) Int. Cl.
*B27L 7/00* (2006.01)

(52) U.S. Cl. ..... 144/195.7; 144/193.1; 144/195.8

(58) Field of Classification Search ..... 144/195.7, 144/193.1, 195.8, 195.5, 195.2, 193.2, 366; 254/104

See application file for complete search history.

(56) References Cited

U.S. PATENT DOCUMENTS

| | | | | | |
|---|---|---|---|---|---|
| 345,153 | A | * | 7/1886 | Latchford | 441/51 |
| 1,356,413 | A | * | 10/1920 | Staub | 254/104 |
| 4,033,390 | A | * | 7/1977 | Piontkowski | 144/195.7 |
| 4,211,264 | A | * | 7/1980 | Cross | 144/195.7 |
| 4,274,458 | A | * | 6/1981 | Dueweke et al. | 144/195.7 |
| 4,391,311 | A | * | 7/1983 | Levercom | 144/195.7 |
| 4,553,576 | A | * | 11/1985 | Maingueneau | 144/194 |
| 4,898,220 | A | * | 2/1990 | Maingueneau | 144/194 |

* cited by examiner

*Primary Examiner*—Bena Miller

(57) ABSTRACT

A splitting wedge is provided for splitting wood. The wedge includes an upwardly facing impact surface, a collar adapted to slidably engage a vertical guide track and a downwardly facing cutting edge. The wedge is adapted to slide down the guide track and cut into an object to split, such as a wood log, when struck on the impact surface. The collar can include a bore to slidably engage a tubular guide track. The impact surface is off-set from the wedge towards to the collar.

2 Claims, 13 Drawing Sheets

KIT TO FORM A WOOD SPLITTING APPARATUS

This application is a divisional of application of Ser. No. 10/483,173 filed Jan. 8, 2004 Now U.S. Pat. No. 7,040,363 which is a 371 of PCT/CA02/00719 filed May 17, 2002.

FIELD OF THE INVENTION

The present invention relates to a kit which, upon assembly, forms a wood splitting apparatus.

BACKGROUND OF THE INVENTION

The principle of driving a wedge into a piece of wood in order to split the wood is well known. This principle has been utilized in numerous existing patents including: U.S. Pat. Nos. 720,010; 3,982,572; 4,033,390; 4,211,264; and 4,391,311. The problem with apparatus built in accordance with the teachings of these existing patents is that the apparatus take up too much room.

SUMMARY OF THE INVENTION

What is required is a compact kit of parts which can be readily transported by a camper in a compact form and then assembled to form a wood splitting apparatus at a campsite.

According to the present invention there is provided a kit to form a wood splitting apparatus. The kit includes a guide track. Means is provided for mounting the guide track to a vertical support. A splitting wedge is provided which is adapted to engage and move along the guide track. In one embodiment, the splitting wedge has an upwardly facing impact surface and a downwardly facing cutting edge. The impact surface is offset from the cutting edge such that the approximate center of the impact surface is closer to the guide track than the approximate center of the cutting edge. Means is provided limiting movement of the splitting wedge along the guide track.

The kit, as described above, can be carried in a compact form and then readily assembled at the campsite and mounted to a vertical support, such as a tree, for use as a wood splitting apparatus.

Although beneficial results may be obtained through the use of the kit, as described above, it is preferred that the guide track itself be capable of assembly and disassembly. It is envisaged that at least two elongate guide members will be provided which are adapted for connection in end to end relation.

Although beneficial results may be obtained through the use of the kit, as described above, as a supplemental feature it is considered desirable to have the collar pivot about the guide track. This facilitates lateral positioning of the splitting wedge.

There are various ways in which the guide members may be connected. For example, the guide members can be connected through a mating telescopic engagement. This mating telescopic engagement may or may not include a threaded connection. Beneficial results have also been obtained when the first elongate guide member is tubular with a first interior bore and the second elongate guide member is tubular with a second interior bore. This enables the first connection end and the second connection end to be reinforced by inserting an internal connection reinforcing member into both the first interior bore and the second interior bore bridging the connection.

There are various alternative ways in which the guide track can be mounted to a vertical support, such as a tree. Beneficial results have been obtained when the first mounting end and the second mounting end each have screw receiving openings adapted to receive mounting screws. When it is considered undesirable to secure the guide track to a tree, a vertical support can be provided as part of the kit. It is envisaged that this vertical support would be a stake which is adapted to be driven into the ground.

Although beneficial results may be obtained through the use of the kit, as described above, as a supplemental feature it may be considered desirable to provide means to bias the splitting wedge toward one end of the guide track. For example, the means to bias the splitting wedge could be either a spring or a telescopic fluid activated shock.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
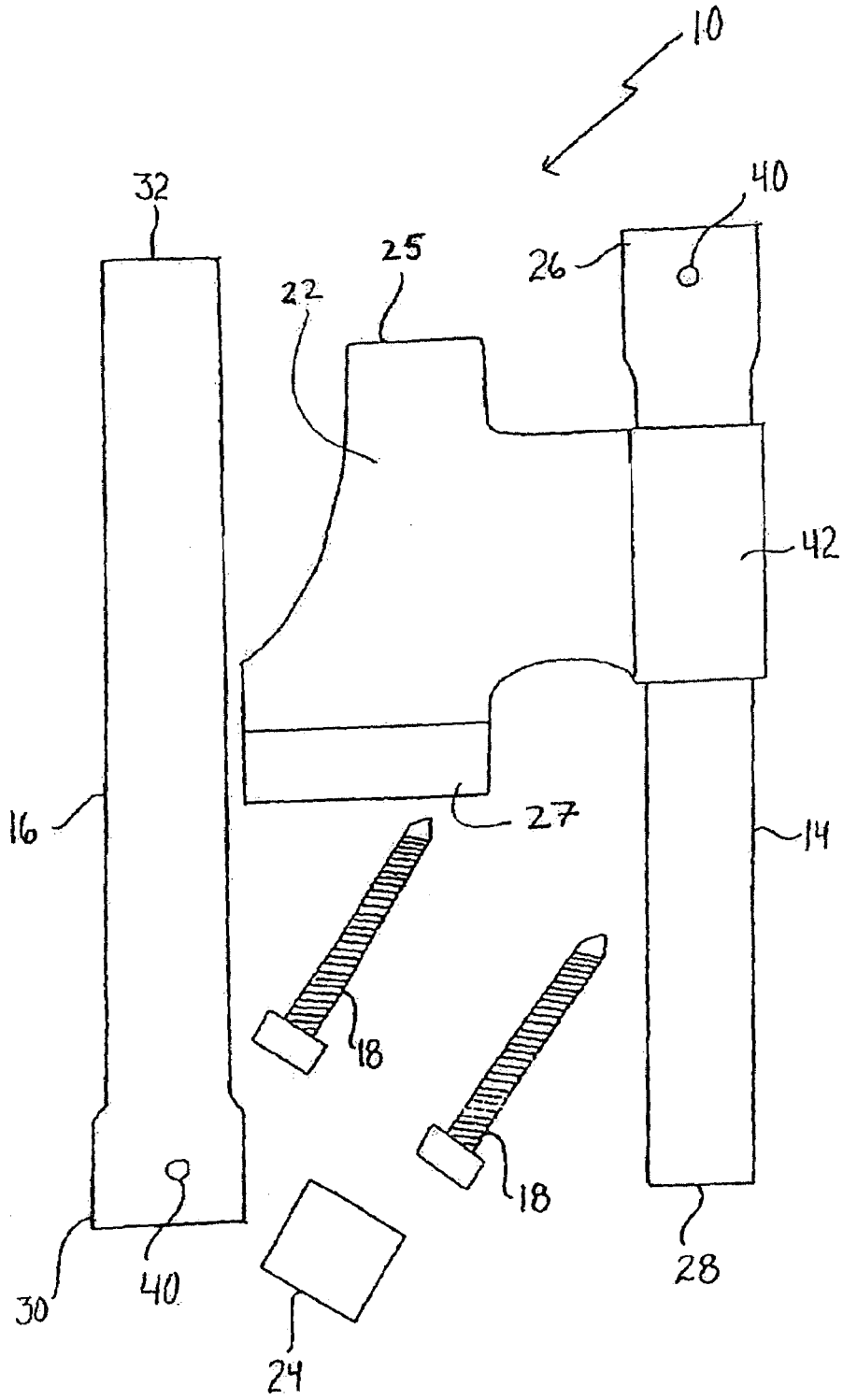
FIG. 1 is a top plan view of a kit which, upon assembly, forms a wood splitting apparatus constructed in accordance with the teachings of the present invention.

The preferred embodiment, a kit to form a wood splitting apparatus generally identified by reference numeral 10, will now be described with reference to FIGS. 1 through 4.

Figure 2:
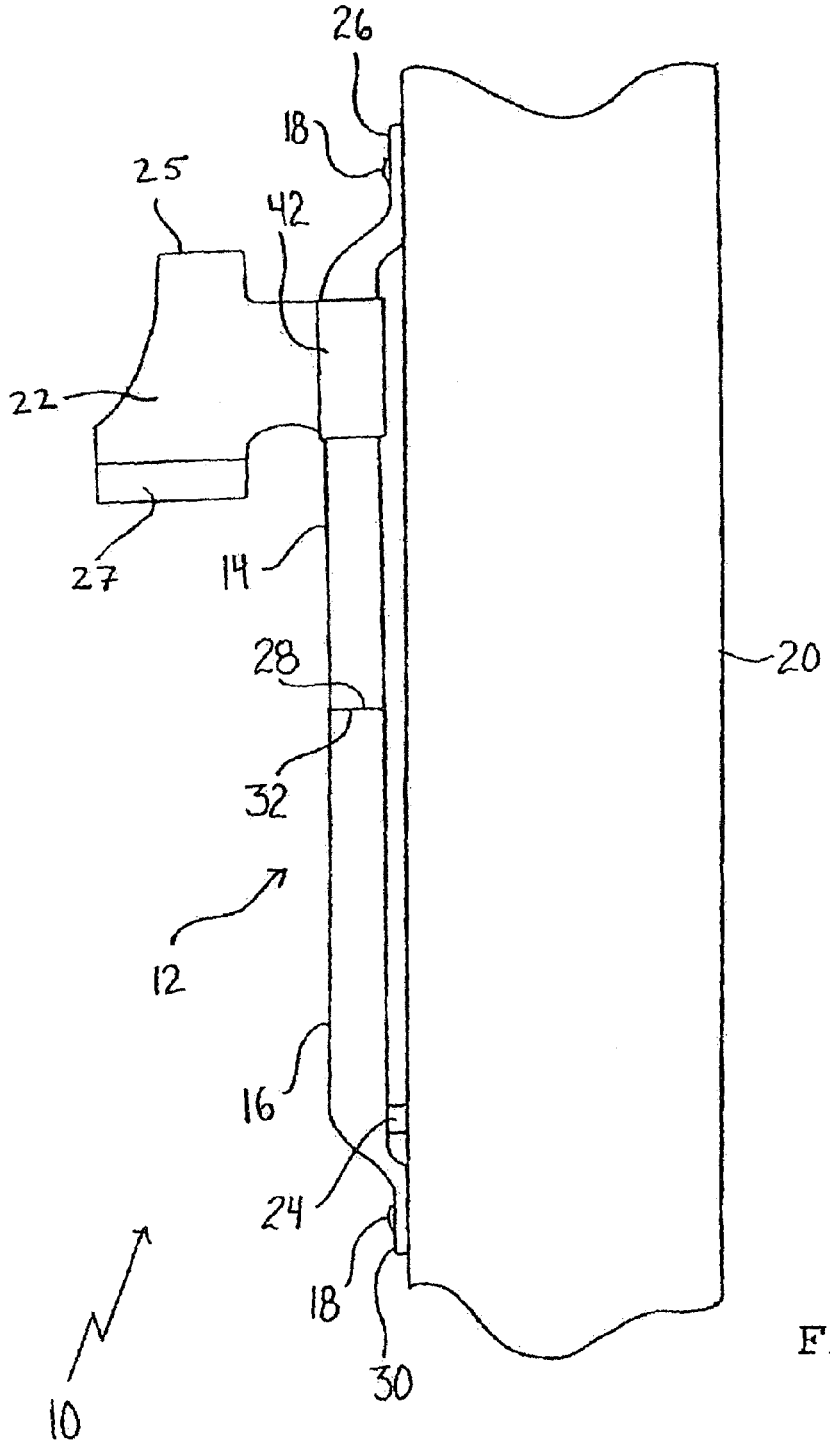
FIG. 2 is a side elevation view of an assembled wood splitting apparatus using the kit illustrated in FIG. 1.

Structure and Relationship of Parts:

Referring to FIG. 2, kit 10 includes a guide track generally referenced by numeral 12 that is capable of assembly and disassembly. In the illustrated embodiment, guide track 12 has a first elongate tubular guide member 14 and a second elongate guide member 16 which are adapted for connection in end to end fashion. It will be appreciated that guide track 12 could also include additional elongate guide members. Kit 10 also includes mounting screws 18 for mounting guide track 12 to a vertical support 20. A splitting wedge 22 is provided that is adapted to engage and move along guide track 12. In one embodiment, splitting wedge 22 comprises upwardly facing impact surface 25 and downwardly facing cutting edge 27. A resilient impact absorbing stop 24 is provided for limiting movement of splitting wedge 22 along guide track 22.

Referring to FIG. 1, first elongate guide member 14 has a first mounting end 26 that is adapted for mounting to vertical support 20 as illustrated in FIG. 2, and a first connective end 28. Second elongate guide member 16 has a second mounting end 30 for mounting to vertical support 20 as illustrated in FIG. 2, and a second connective end 32 adapted for coupling with first connective end 28 of first elongate guide member 14.

Figure 3:
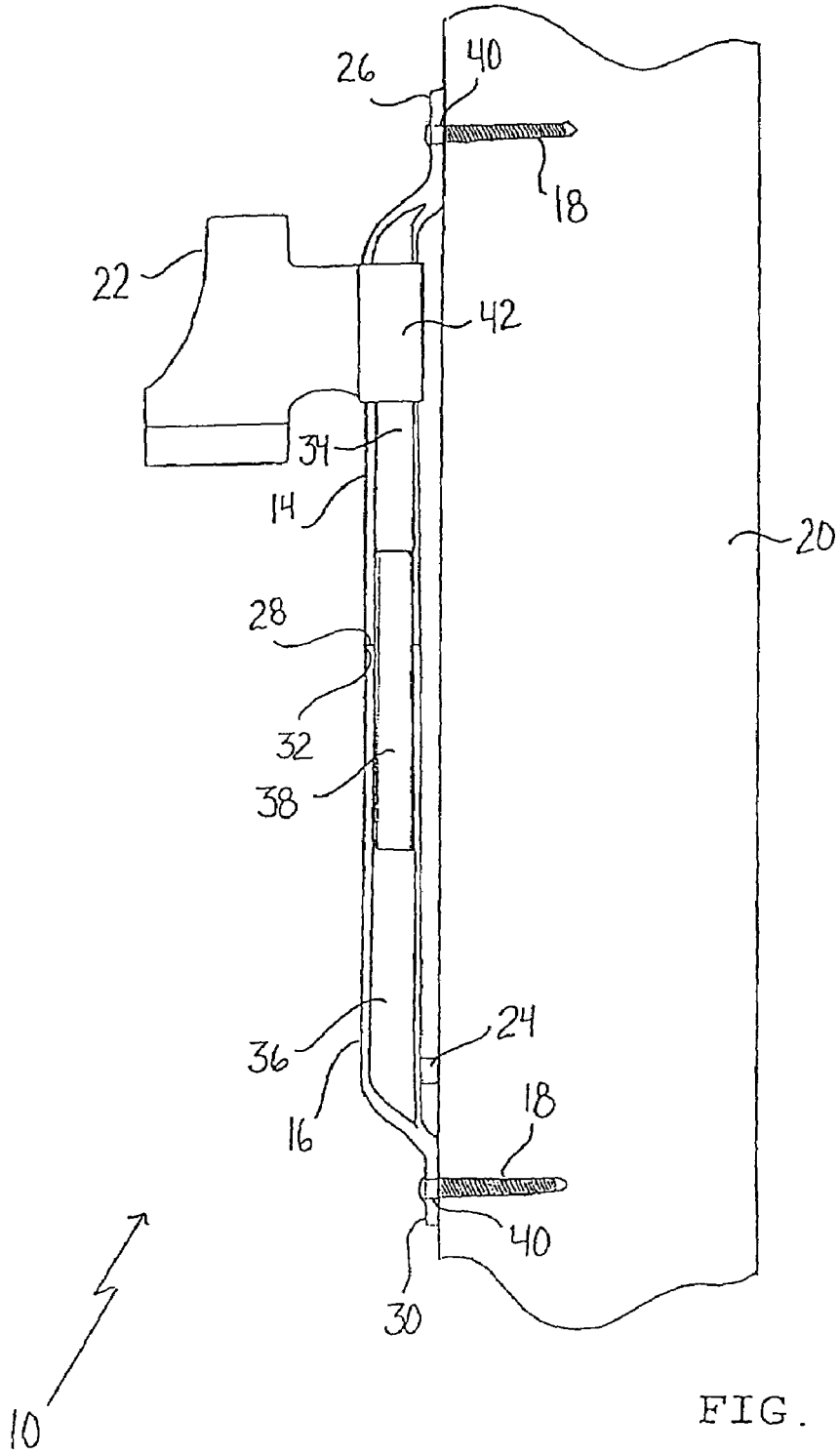
FIG. 3 is a side elevation view, in section, of the assembled wood splitting apparatus using the kit illustrated in FIG. 1.

Referring to FIG. 3, in the illustrated embodiment, first elongate guide member 14 is tubular with a first interior bore 34. Second elongate guide member 16 is tubular with a second interior bore 36. An internal connection reinforcing member 38 is provided that is adapted for positioning in both first interior bore 34 and second interior bore 36, thereby reinforcing the connection between first connective end 28 and second connective end 32. It will be appreciated that first elongate guide member 14 and second elongate guide member 16 do not have to be tubular. Furthermore, there are other means for securing first elongate guide member 14 and second elongate guide member 16 together in end to end fashion, examples of which will be described below.

Referring to FIG. 3, first mounting end 26 and second mounting end 30 are tapered and each have screw receiving openings 40 that are adapted to receive mounting screws 18 for the purpose of securing guide track 12 to vertical support 20. It will be appreciated that there are other means that can be used secure to either or both of first mounting end 26 and second mounting end 30 to vertical support 20.

Referring to FIG. 2, splitting wedge 22 has a guide track engaging collar 42 which slides over and along guide track 12. Collar 42 is also able to pivot about guide track 12, thereby facilitating lateral positioning of splitting wedge 22. In the illustrated embodiment, splitting wedge 22 and guide track engaging collar 42 are unitarily formed, however splitting wedge 22 that is detachable from guide track engaging collar 42 can also be used. In another embodiment, impact surface 25 is offset from cutting edge 27 such that the approximate center of impact surface 25 is closer to guide track engaging collar 42 than the approximate center of cutting edge 27.

Operation:

The use and operation of kit to form a wood splitting apparatus generally identified by reference numeral 10 will now be described with reference to FIGS. 1 through 4. Referring to FIG. 1, kit 10, as described above, can be carried in a disassembled compact form and then readily assembled at a campsite, cottage or similar location, and mounted to vertical support such as a tree 20, as illustrated in FIG. 2, for use as a wood splitting apparatus.

Referring to FIG. 3, in order to assemble kit 10, collar 42 of splitting wedge 22 slides over first connective end 28 of first elongate tubular member 14. First elongate tubular guide member 14 and second elongate tubular guide member 16 are assembled to form guide track 12. This is done by aligning first connective end 28 and second connective end 32, and positioning internal connection reinforcing member 38 in both first interior bore 34 and second interior bore 36, thereby reinforcing the connection between first connective end 28 and second connective end 32. Splitting wedge 22 is able to move laterally along guide track 12, but cannot slide over first mounting end 26 or second mounting end 30. Collar 42 is able to pivot about guide track 12, thereby facilitating lateral positioning of splitting wedge 22.

To secure guide track 12 to vertical support 20, one of mounting screws 18 is inserted through screw receiving opening at first mounting end 26 to secure first mounting end 26 to vertical support 20. Another of mounting screws 18 is inserted through screw receiving opening 40 at second mounting end 30 to secure second mounting end 30 to vertical support 20.

Figure 4:
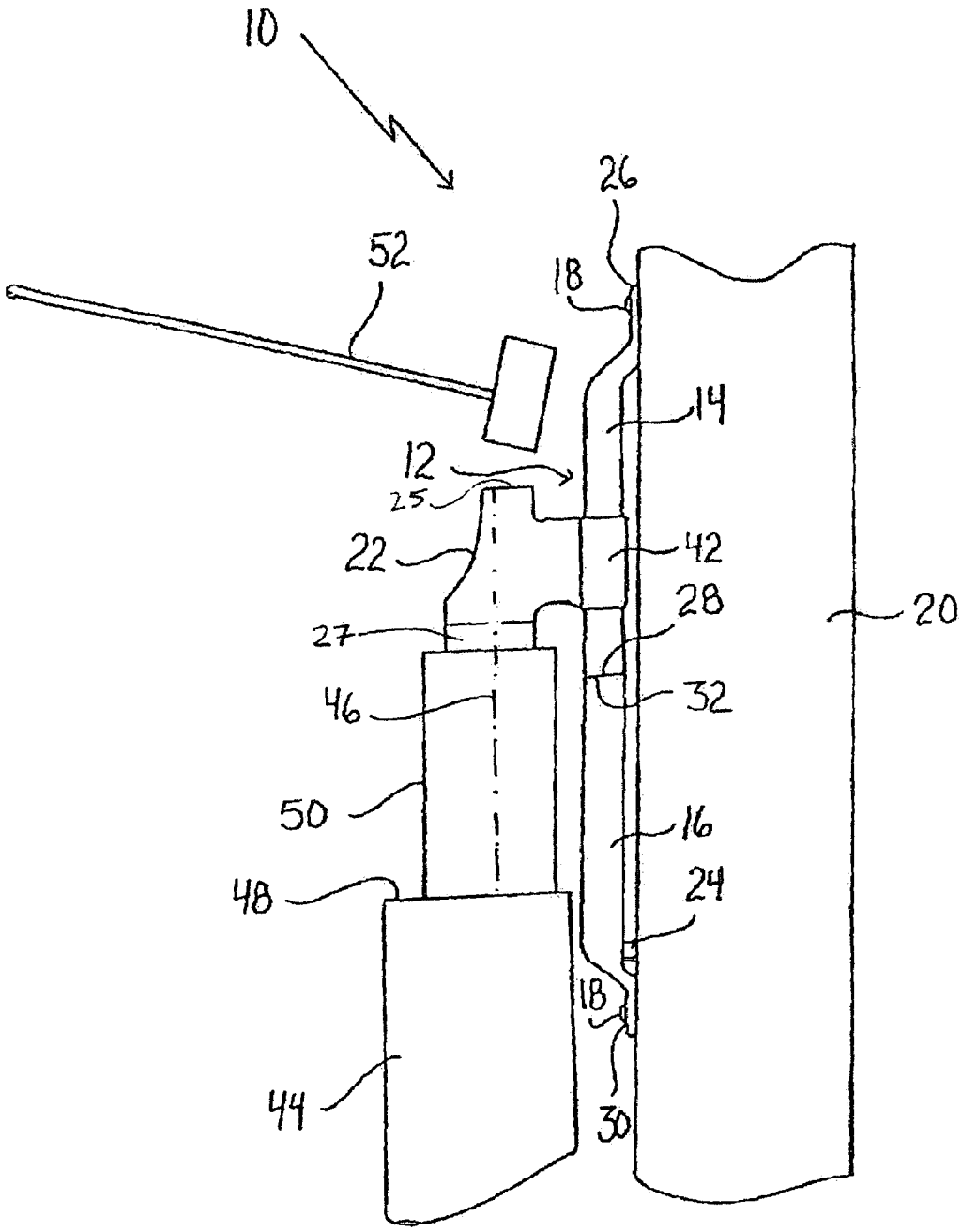
FIG. 4 is a side elevation view of a wood splitting apparatus assembled using the kit illustrated in FIG. 1.

Referring to FIG. 4, once kit 10 has been properly assembled and secured to vertical support 20, wood splitting can commence. In the illustrated embodiment, a support block such as a block cut of wood 44 is selected and is placed in a travel path 46 of splitting wedge 22. Support block 44 has a flat upper surface 48 upon which a piece of wood 50 that is to be split is supported at a height relative to guard track 12, such that as splitting wedge 22 travels along travel path 46 through wood 50, the travel of splitting wedge 22 is stopped upon impact with flat upper surface 48 of support block 44. This prevents collar 42 of splitting wedge 22 from becoming jammed at second mounting end 30 of second elongate guide member 16 where second mounting end 30 is secured to vertical support 20. In the illustrated embodiment, support block 44 is shown as being a block of cut wood, however it will be appreciated that other materials could also be used as support block 44 so long as wood to be cut 50 is supported at the appropriate height to prevent jamming of collar 42 of splitting wedge 22.

Splitting wedge 22 can be lifted laterally or pivoted to the left or right to allow wood 50, to be placed on support block 44. Referring to FIG. 2, resilient impact absorbing stop 24 is placed between second elongate guide member 16 and vertical support 20 at second mounting end 30. Resilient impact absorbing stop 24 prevents collar 42 of splitting wedge 22 from becoming jammed between second elongate guide member 16 and vertical support 20 when splitting wedge 22 is resting at or near second mounting end 30. Referring to FIG. 4, after placement of wood 50 on stop block 44, splitting wedge 22 can be pivoted to the left or right, and raised into position on wood 50. Referring to FIG. 4, a sledge hammer 52 or other suitable striking tool, can be used to strike splitting wedge 22 such that the downward force of sledge hammer 52 striking splitting wedge 22 caused splitting wedge 22 to travel along travel path 46 and through wood 50. As shown in FIG. 4, travel path 46 passes through the approximate center of cutting edge 27, which is offset from the approximate center of impact surface 25 in relation to guide track engaging collar 42. Splitting wedge 22 can be repeatedly struck until splitting wedge 22 has fully passed through wood 50, thereby splitting wood 50, and is stopped from further downward travel by upper surface 48 of support block 44.

Figure 6:
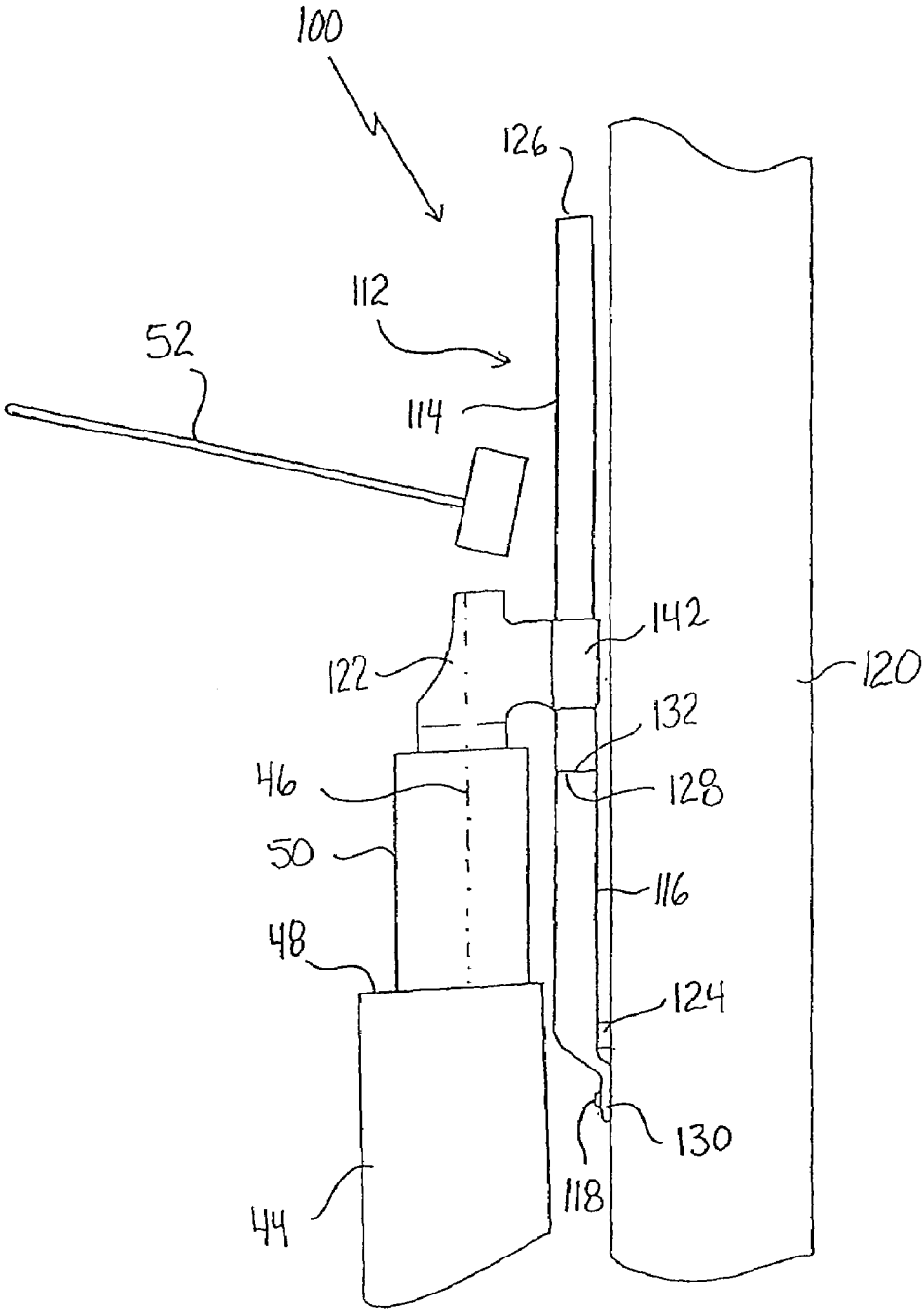
FIG. 6 is a side elevation view of an assembled wood splitting apparatus using the kit illustrated in FIG. 5.

Structure and Relationship of Parts:

Referring to FIG. 6, a second embodiment of kit 100 includes a guide track generally referenced by numeral 112 that is capable of assembly and disassembly. In the illustrated embodiment, guide track 112 has a first elongate tubular guide member 114 and a second tubular elongate guide member 116 which are adapted for connection in end to end fashion, however it will be appreciated that guide track 112 could also include additional elongate tubular guide members. Kit 100 also includes mounting screw 118, for mounting guide track 112 to a vertical support such as a tree 120. A splitting wedge 122 is provided that is adapted to engage and move along guide track 112. A resilient impact absorbing stop 124 is provided for limiting movement of splitting wedge 122 along guide track 112.

Figure 5:
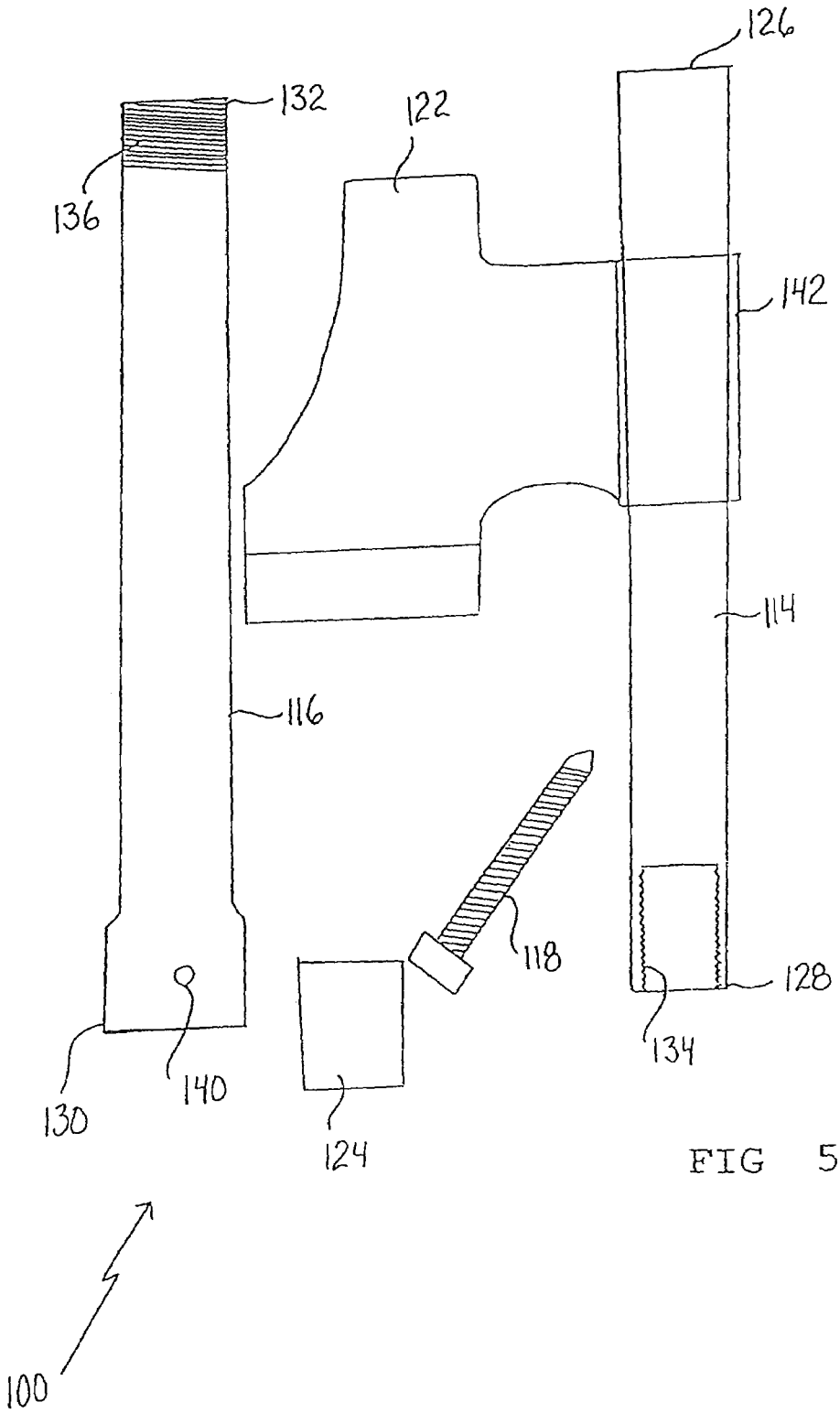
FIG. 5 is a top plan view, in section, of a second embodiment of the kit which, upon assembly, forms a wood splitting apparatus constructed in accordance with the teachings of the present invention.

Referring to FIG. 5, in the illustrated embodiment, first elongate guide member 114 has a first upper end 126 and a first connective end 128. Second elongate guide member 116 has a tapered mounting end 130 for mounting to vertical support 120 and a second connective end 132. First connective end 128 of first elongate guide member 114 has interior threads 134 while second connective end 132 has exterior threads 136 such that first connective end 128 is threaded with second connective end 132 in order to couple first elongate guide member 114 with second elongate guide member 116 so as to form guide track 112. Mounting end 130 of second elongate guide member 116 has a screw receiving opening 140 for receiving mounting screw 118 to secure guide track 112 to vertical support 120 illustrated in FIG. 6. Referring to FIG. 6, only mounting end 130 of second elongate guide member 116 is adapted to be mounted to vertical support 120. First upper end 126 of first elongate guide member 114 is unattached and is supported only by second elongate guide member 116.

Splitting wedge 122 of kit 100 has a guide track engaging collar 142 which slides over first upper end 126 of first elongate guide member 114 and along guide track 112. Collar 142 is also able pivot about guide track 112, thereby facilitating lateral positioning of splitting wedge 122. Collar 142 of splitting wedge 122 can easily be removed from guide track 112 by sliding collar 142 up and off of first upper end 126 of first elongate guide member 114. This allows for splitting wedge 122 to be removed from guide track 112 for storage when not in use, while guide track 112 remains mounted to vertical support 120.

Operation:

The use and operation of kit to form a wood splitting apparatus generally identified by reference numeral 100 will now be described with reference to FIGS. 5 and 6. Referring to FIG. 5, as with kit 10, second embodiment of kit 100 as described above, can be carried in a disassembled compact form and then readily assembled at a campsite, cottage or similar location, and mounted to vertical support such as a tree 120 illustrated in FIG. 6, for use as a wood splitting apparatus.

Referring to FIG. 6, with second embodiment of kit 100, first elongate tubular guide member 114 and second elongate tubular guide member 116 are threadably coupled to form guide track 112. Only mounting end 130 of second elongate guide member 116 is secured to vertical support 120 by inserting mounting screw 118 through screw receiving opening 140 at mounting end 130 to secure mounting end 130 of second elongate guide member 116 to vertical support 120. Resilient impact absorbing stop 124 is positioned between mounting end 130 of second elongate guide member 116 and vertical support 120. By only mounting second elongate guide member 116 to vertical support 120, collar 142 of splitting wedge 122 is permitted to slide over first upper end 126 of first tubular member 114 for positioning on guide track 112, yet can also be slipped off first upper end 126 of first elongate guide member 114 for easy removal of splitting wedge 122 from guide track 112. This may be desirable for safety reasons where small children are around. When not in use, splitting wedge 122 can easily be removed for storage out of the reach of children while guide track 112 can remain mounted to vertical support 120. Where it is necessary to easily remove guide track 112 as well from vertical support 120, a detachable leg screw can be used instead of mounting screw 118.

Referring to FIG. 6, once kit 100 has been properly assembled and secured to vertical support 120, wood splitting can commence. Second embodiment 100 is used to split wood in the same manner as described with first embodiment 10.

Structure and Relationship of Parts

Figure 8:
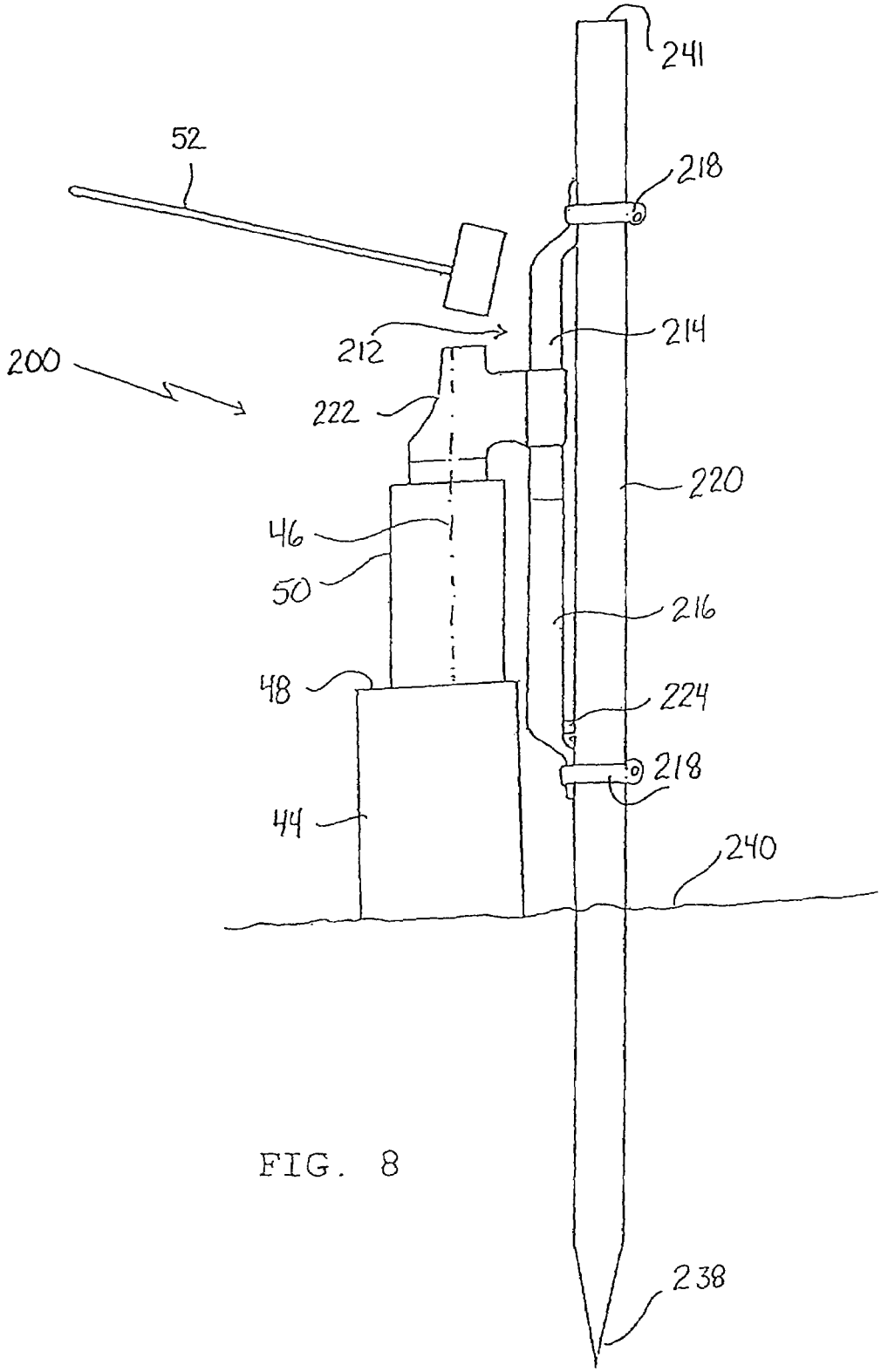
FIG. 8 is a side elevation view of an assembled wood splitting apparatus using the kit illustrated in FIG. 5.

Referring to FIG. 8, a third embodiment of kit 200 is provided which includes a guide track generally referenced by numeral 212 that is capable of assembly and disassembly. In the illustrated embodiment, guide track 212 has a first elongate guide member 214 and a second elongate guide member 216 which are adapted for connection in end to end fashion, however it will be appreciated that guide track could include additional elongate guide members. Kits 200 also includes mounting clamps 218 and a vertical support 220 which is shaped like a stake. Mounting clamps 218 are used for mounting guide track 212 to vertical support 220. A splitting wedge 222 is provided that is adapted to engage and move along guide track 212. A resilient impact absorbing member 224 is provided for limiting movement of splitting wedge 222 along guide track 212.

Figure 7:
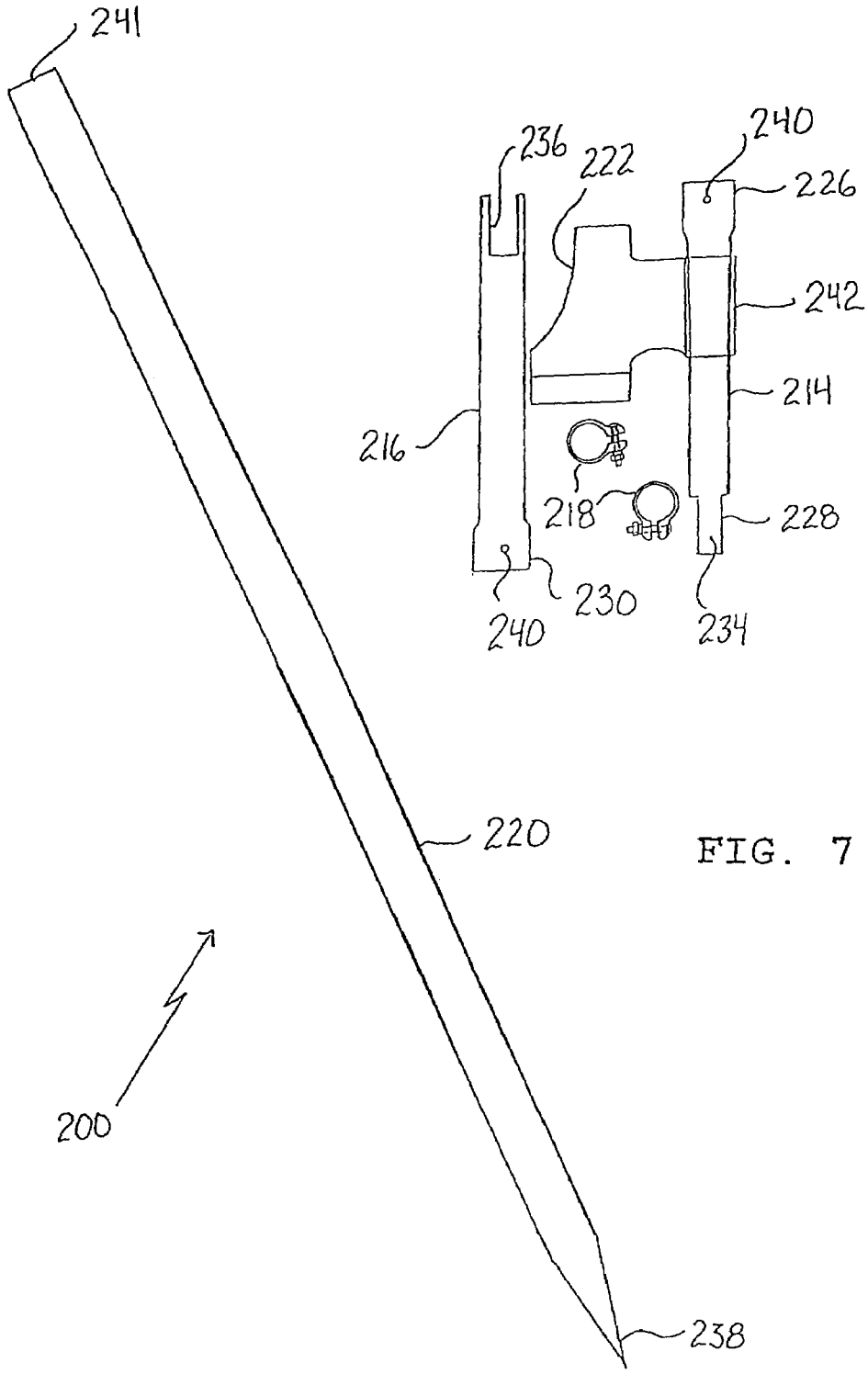
FIG. 7 is a top plan view, in section, of a third embodiment of the kit which, upon assembly, forms a wood splitting apparatus constructed in accordance with the teachings of the present invention.

Referring to FIG. 7, in the illustrated embodiment, first elongate guide member 214 has a first mounting end 226 that is adapted for mounting to vertical support 220 and a first connective end 228. Second elongate guide member 216 has a second mounting end 230 for mounting to vertical support 220 and a second connective end 232. First connective end 228 of first elongate guide member 214 has a male member 234, while second connective end 232 of second elongate guide member 216 has a female receptacle 236 that is adapted to received male member 234 of first elongate guide member 214 so as form guide track 212.

Referring to FIG. 8, splitting wedge 222 has a guide track engaging collar 242 which slides over and along guide track 212. Collar 242 is also able pivot about guide track 212, thereby facilitating lateral positioning of splitting wedge 222.

Operation:

The use and operation of third embodiment of kit 200 will now be described with reference to FIGS. 7 and 8. Referring to FIG. 7, kit 200, as described above, can be carried in a disassembled compact form and then readily assembled at a campsite, cottage or similar location, and mounted to vertical support 220 which is provided with kit 200, for use as a wood splitting apparatus.

Referring to FIG. 7, third embodiment of kit 200 differs from first embodiment 10 and second embodiment 100 in that vertical support 220 is included in kit 200. Referring to FIG. 8, this is desirable for use where there is no suitable support such as a post or tree to be found in the environment. In that situation, vertical support 220 has a first pointed end 238 that is adapted to be embedded into a ground surface 240, and a second end 241 that remains above ground surface 240. Once vertical support 220 has been secured in ground surface 240, remainder of kit 200 can be assembled.

Referring to FIG. 8, in order to assemble kit 200, collar 242 of splitting wedge 222 slides over first connective end 28 of first elongate guide member 214. First connective end 228 of first elongate guide member 214 is then coupled with second connective end 232 of second elongate guide member 216 to form guide track 212. Mounting clamps 218 are used to secure guide track 212 to vertical support 220.

Resilient impact absorbing member 224 is positioned between second mounting end 230 of second elongate guide member 216 and vertical support 220 to prevent splitting wedge 222 from becoming jammed between second mounting end 230 and vertical support 220.

Once third embodiment 200 has been assembled, splitting of wood can commence in the same manner as described above with first embodiment 10 and second embodiment 100.

Structure and Relationship of Parts

Figure 9:
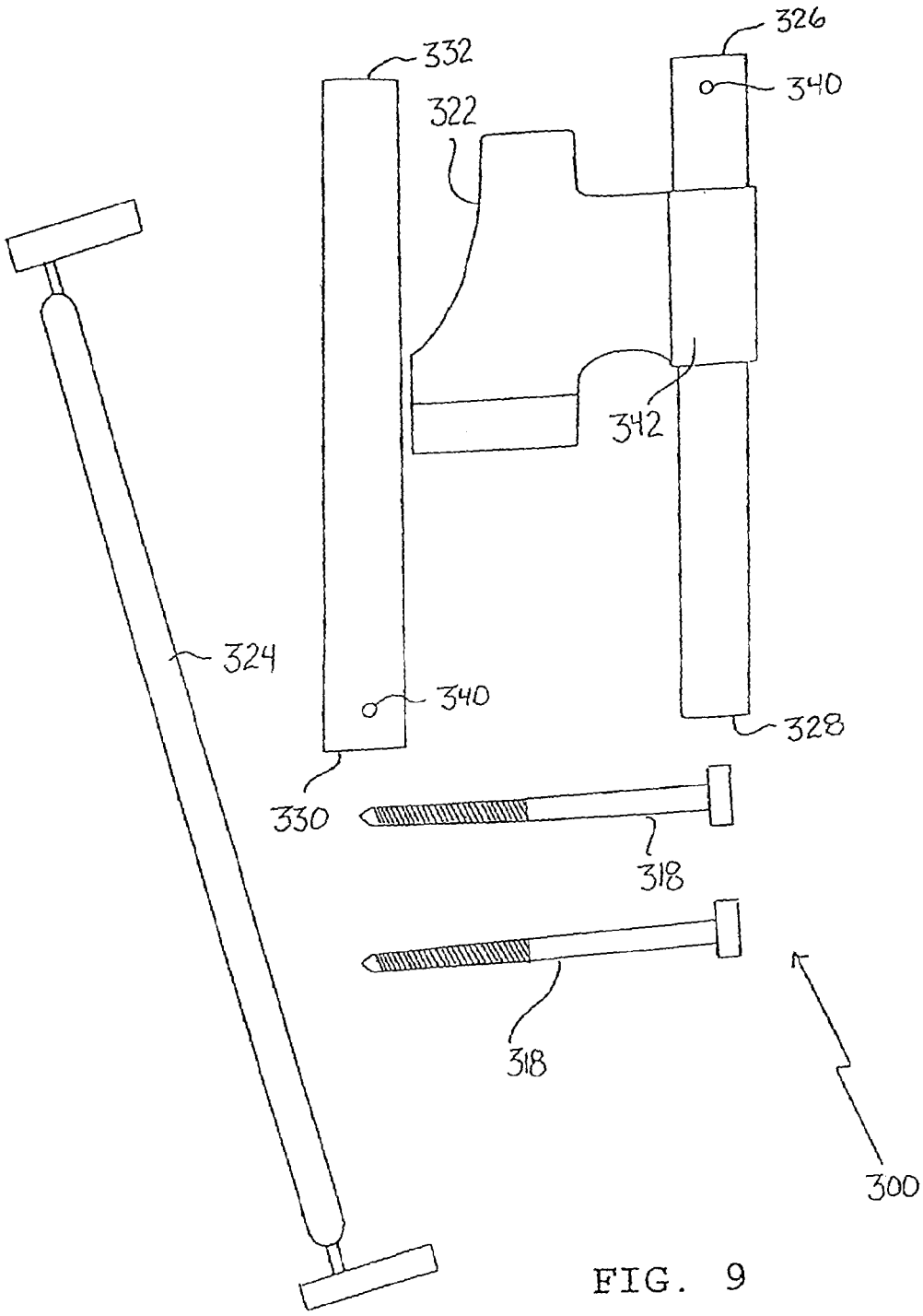
FIG. 9 is a top plan view of a fourth embodiment of the kit which, upon assembly, forms a wood splitting apparatus constructed in accordance with the teachings of the present invention.
Figure 10:
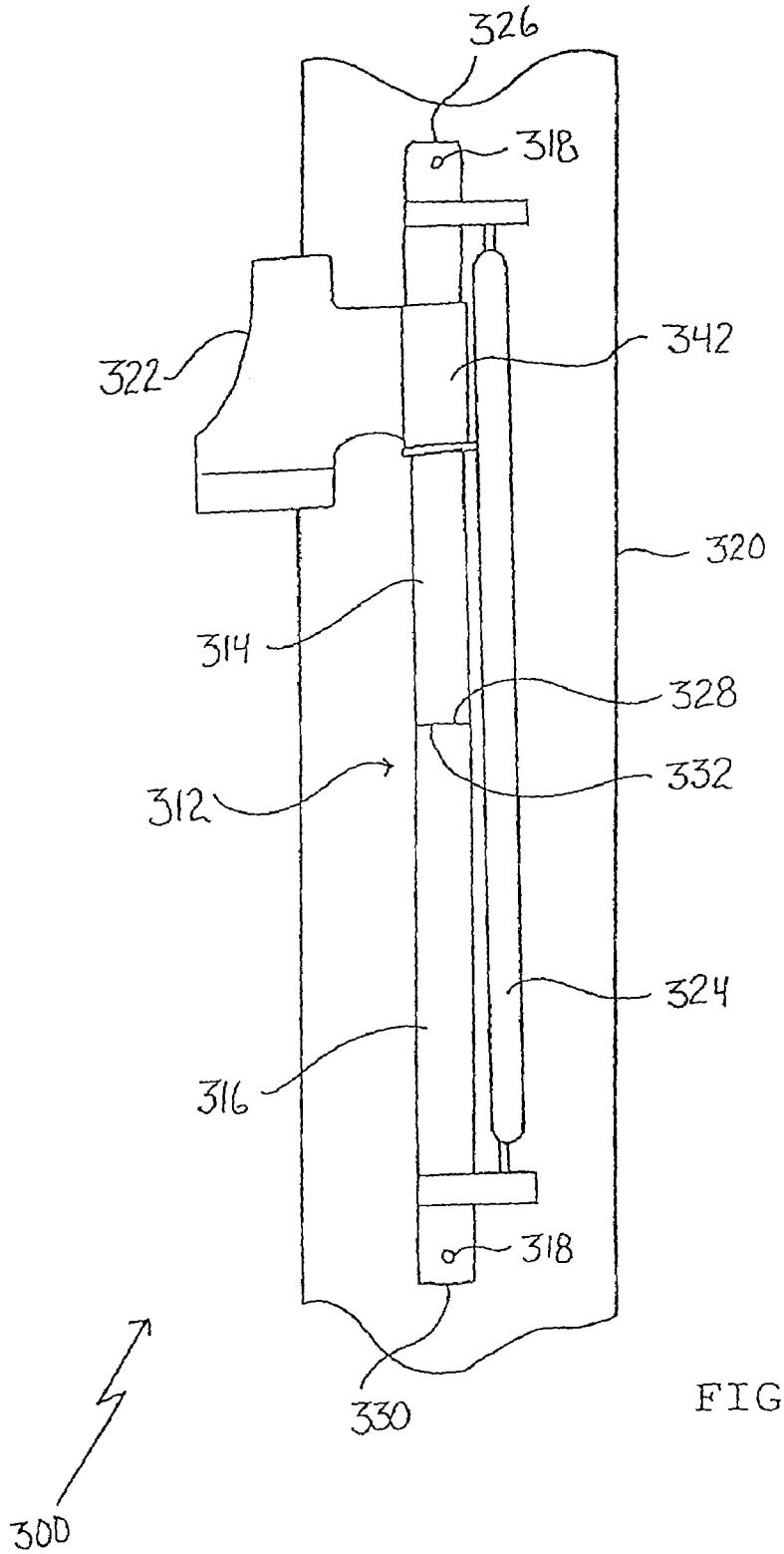
FIG. 10 is a front elevation view of an assembled wood splitting apparatus using the kit illustrated in FIG. 9.
Figure 11:
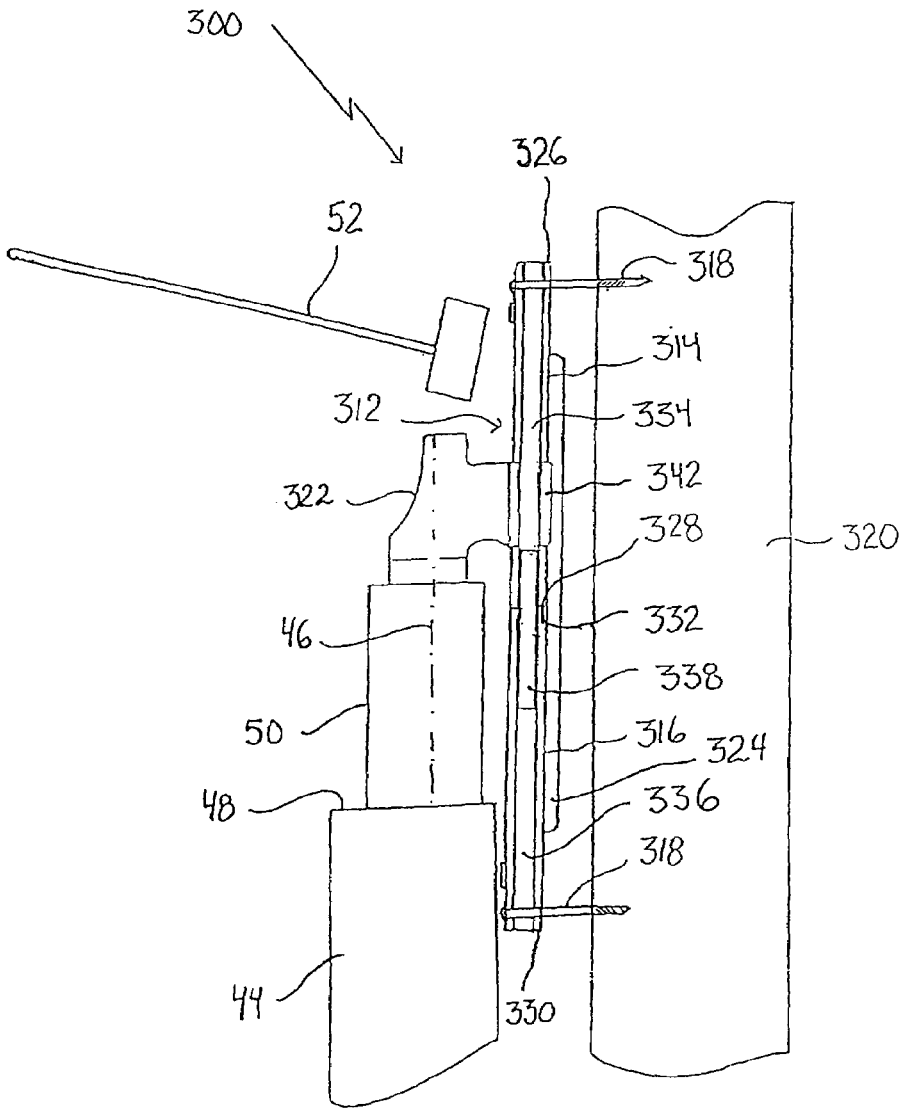
FIG. 11 is a side elevation view, in section, of an assembled wood splitting apparatus using the kit illustrated in FIG. 9.

Referring to FIGS. 9 through 11, a fourth embodiment of kit 300 is provided which includes a guide track 312 that is capable of assembly and disassembly. Referring to FIG. 10, in the illustrated embodiment, guide track 312 has a first elongate guide member 314 and a second elongate guide member 316 which are adapted for connection in end to end fashion, however it will be appreciated that guide track 312 could also include additional elongate guide members. Referring to FIG. 9, kit 300 also includes mounting screws 318, for mounting guide track 312 to vertical support 320 illustrated in FIG. 11. Referring to FIG. 10, a splitting wedge 322 is provided that is adapted to engage and move along guide track 312. A telescopic fluid activated shock 324 is also included in fourth embodiment of kit 300.

Referring to FIG. 9, first elongate guide member 314 has a first mounting end 326 that is adapted for mounting to a vertical support 320 and a first connective end 328. Second elongate guide member 316 has a second mounting end 330 for mounting to vertical support 320 and a second connective end 332.

Referring to FIG. 11, in the illustrated embodiment, first elongate guide member 314 is tubular with a first interior bore 334. Second elongate guide member 316 is tubular with a second interior bore 336. An internal connection reinforcing member 338 is provided that is adapted for positioning in both first interior bore 334 and second interior bore 336, thereby reinforcing the connection between first connective end 328 and second connective end 332. Each of first mounting end 326 and second mounting end 330 have screw receiving openings 340 that are adapted to receive mounting screws 318 for the purpose of securing guide track 312 to vertical support 320.

Referring to FIG. 10, telescopic fluid activated shock 324 is secured to splitting wedge 322 so as to bias splitting wedge 322 toward mounting end 326 of first elongate guide member 314 of guide track 312. In the illustrated embodiment, telescopic fluid activated shock 324 is shown as being installed adjacent and parallel to guide track 312, however it will be appreciated that there are other positions in which telescopic fluid activated shock 324 can be installed and still bias splitting wedge 322 toward mounting end 326 of first elongate guide member 314 of guide track 312. It will also be appreciated that a spring could also be used in place of telescopic fluid activated shock 324 for the purposes of biasing splitting wedge 322 toward mounting end 326 of first elongate guide member 314 of guide track 312.

Operation:

The use and operation of fourth embodiment of kit 300 will now be described with reference to FIGS. 9 through 11. Referring to FIG. 9, fourth embodiment of kit 300 as described above, can be carried in a disassembled compact form and then readily assembled at a campsite, cottage or similar location, and mounted to vertical support such as a tree 320, as illustrated in FIG. 11, for use as a wood splitting apparatus.

Referring to FIG. 10, to assemble kit 300, collar 342 of splitting wedge 322 slides over first connective end 328 of first elongate guide member 314. First elongate guide member 314 and second guide member 316 are assembled to form guide track 312. This is done by aligning first connective end 328 and second connective end 332, and positioning internal connection reinforcing member 338 in both first interior bore 334 and second interior bore 336, thereby reinforcing the connection between first connective end 328 and second connective end 332. Telescopic fluid activated shock 324 is secured to splitting wedge 322 so as to bias splitting wedge 222 toward mounting end 326 of first elongate guide member 314 of guide track 312. Splitting wedge 322 is able to move laterally along guide track 312, but cannot slide over first mounting end 326 or second mounting end 330. Collar 342 is able to pivot about guide track 312, thereby facilitating lateral positioning of splitting wedge 322.

To secure guide track 312 to a vertical support 320, one of mounting screws 318 is inserted through screw receiving opening 340 at first mounting end 326 to secure first mounting end 326 to vertical support 320. Another of mounting screws 318 is inserted through screw receiving opening 340 at second mounting end 330 to secure second mounting end 330 to vertical support 320. In the illustrated embodiment, mounting screws 318 are of a substantial length that the space between guide track 312 and vertical support 320 can be adjusted to accommodate telescopic fluid activate shock 324. Depending on where telescopic fluid activated shock 324 is mounted in relation to splitting wedge 322, mounting screws 318 can be used to adjust the distance between guide track 312 and vertical support 320. Furthermore, mounting screw 318 at second mounting end 330 serves to limit movement of splitting wedge 322 in the event that splitting wedge 322 is disengaged from telescopic fluid activated shock 324.

Referring to FIG. 11, once kit 300 has been properly assembled and secured to vertical support 320, wood splitting can commence. Second embodiment 300 is used to split wood 50 in the same manner as described with first embodiment 10, except that the force of sledge hammer 52 striking splitting wedge 322 must be sufficient to overcome biasing action of telescopic fluid activated shock 324 in order to drive splitting wedge 322 into wood to be cut 50.

Figure 12:
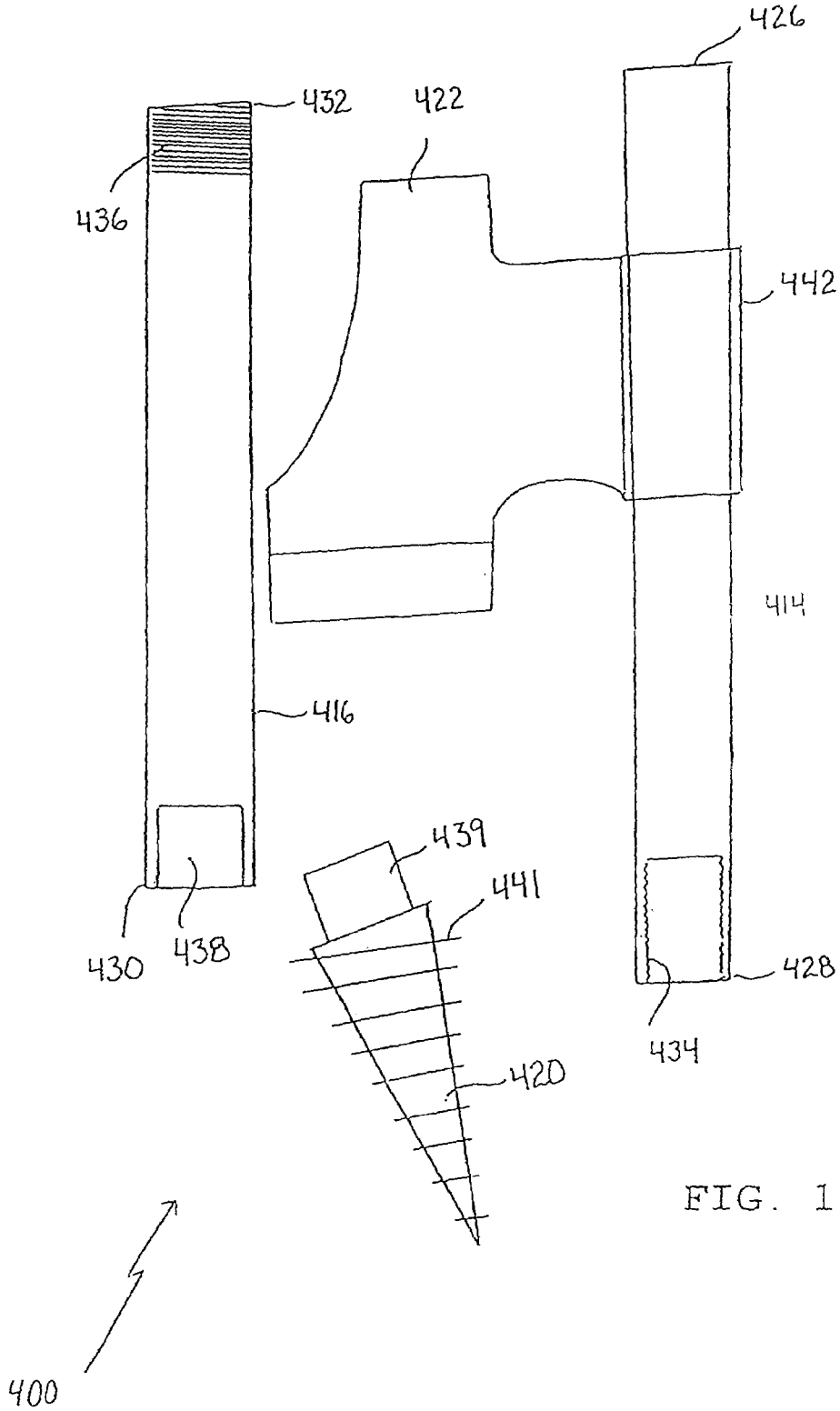
FIG. 12 is a top plan view, in section, of a fifth embodiment of the kit which, upon assembly, forms a wood splitting apparatus constructed in accordance with the teachings of the present invention.
Figure 13:
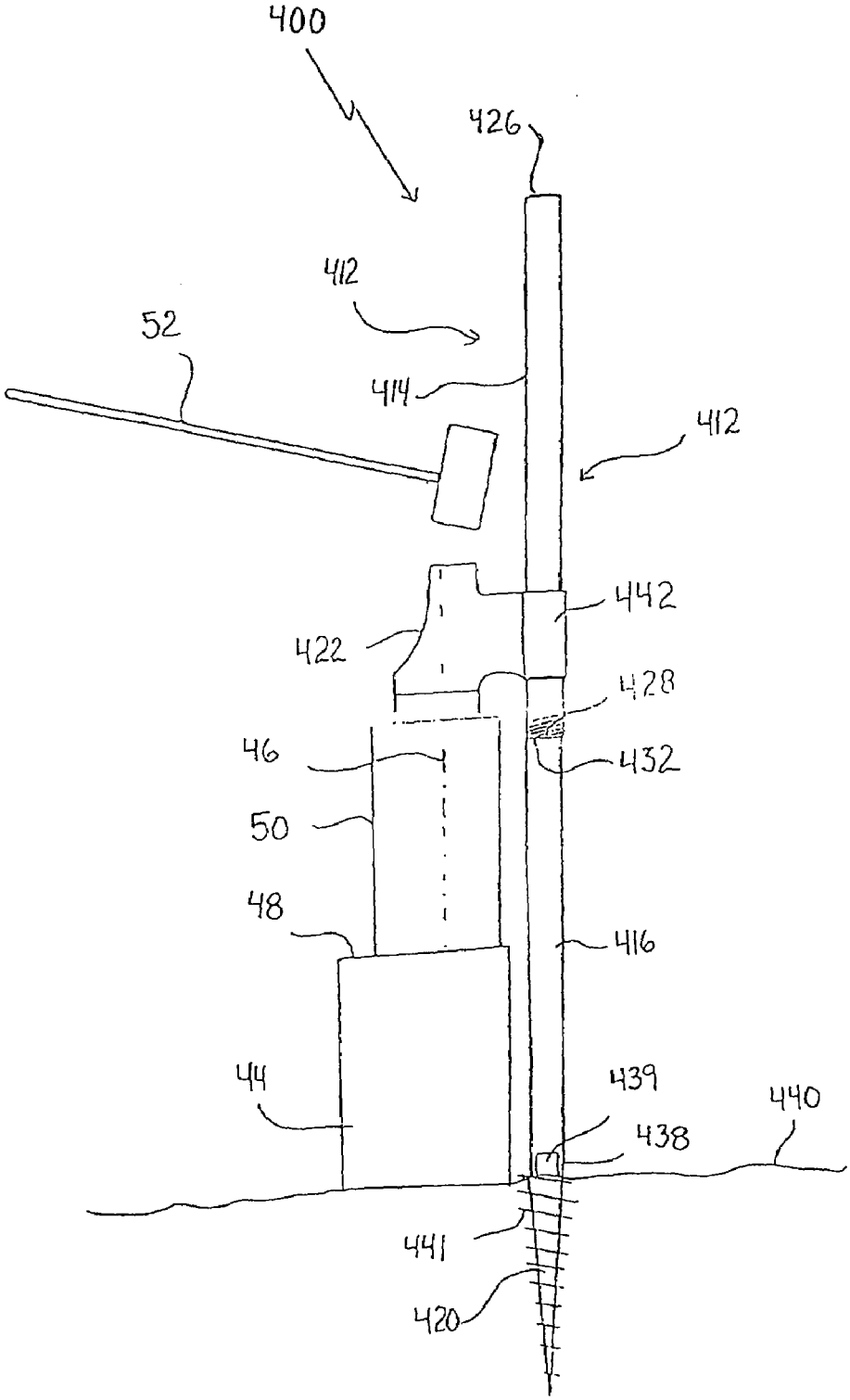
FIG. 13 is a side elevation view, in section, of an assembled wood splitting apparatus using the kit illustrated in FIG. 12.

Structure and Relationship of Parts:

Referring to FIG. 12, a fifth embodiment of kit 400 includes a guide track generally referenced by numeral 412 that is capable of assembly and disassembly. Referring to FIG. 13, in the illustrated embodiment, guide track 412 has a first elongate guide member 414 and a second elongate guide member 416 which are adapted for connection in end to end fashion, however it will be appreciated that guide track 412 could also include additional elongate guide members. Kit 400 also includes an ground anchor 420 which serves as a vertical support 420. A splitting wedge 422 is provided that is adapted to engage and move along guide track 412.

Referring to FIG. 12, in the illustrated embodiment, first elongate guide member 414 has a first upper end 426 and a first connective end 428. Second elongate guide member 416 has a mounting end 430 adapted for mounting to anchor 420, and a second connective end 432. First connective end 428 of first elongate guide member 414 has interior threads 434 while second connective end 432 has exterior threads 436 such that first connective end 428 is threaded with second connective end 432 in order to couple first elongate guide member 414 with second elongate guide member 416 so as to form guide track 412 illustrated in FIG. 13. Mounting end 430 of second elongate guide member 416 has a female receptacle 438. Ground anchor 420 has a male member 439 which is adapted to be inserted into female receptacle 438 of second elongate guide 416 for the purpose of securing second elongate guide 416 to anchor 420, however it will be appreciated that other means can be used to secure ground anchor 420 to mounting end 430 of second elongate guide member 416. Referring to FIG. 12, ground anchor 420 has helical flights 441 which enable ground anchor 420 to be screwed into ground 440 illustrated in FIG. 13.

Referring to FIG. 13, only mounting end 430 of second elongate guide member 416 is adapted to be mounted to ground anchor 420. First upper end 426 of first elongate guide member 414 is unattached and is supported only by second elongate guide member 416.

Splitting wedge 422 of kit 400 has a guide track engaging collar 442 which slides over first upper end 426 of first elongate guide member 414 and along guide track 412. Collar 442 is also able pivot about guide track 412, thereby facilitating lateral positioning of splitting wedge 422. Collar 442 of splitting wedge 422 can easily be removed from guide track 412 by sliding collar 442 up and off of first upper end 426 of first elongate guide member 414. This allows for splitting wedge 422 to be removed from guide track 412 for storage when not in use, while guide track 112 remains mounted to vertical support 420.

Operation:

The use and operation of kit to form a wood splitting apparatus generally identified by reference numeral 400 will now be described with reference to FIGS. 12 and 13. Referring to FIG. 12, as with other embodiments of kits described above, fifth embodiment of kit 400 as described above, can be carried in a disassembled compact form and then readily assembled at a campsite, cottage or similar location illustrated in FIG. 13, for use as a wood splitting apparatus.

Referring to FIG. 13, with fifth embodiment of kit 400, first elongate guide member 414 and second elongate guide member 416 are threadably coupled to form guide track 412. Mounting end 430 of second elongate guide member 416 is secured to ground anchor 420 by inserting male member 441 of ground anchor 420 into female receptacle 440 at mounting end 430 of second elongate member 416. Ground anchor 420 with helical flights 441 is then screwed into ground 440. Fifth embodiment of kit 400 is suitable for use in an area in which alternative forms of vertical supports are unavailable or where space is limited.

By only mounting second elongate guide member 416 to vertical support 420, collar 442 of splitting wedge 422 is permitted to slide over first upper end 426 of first tubular member 414 for positioning on guide track 412, yet can also be slipped off first upper end 426 of first elongate guide member 414 for easy removal of splitting wedge 422 from guide track 412. This may be desirable for safety reasons where small children are around. When not in use, splitting wedge 422 can easily be removed for storage out of the reach of children while guide track 412 can remain mounted to vertical support 420.

Referring to FIG. 13, once kit 400 has been properly assembled, and attached to vertical support 420, and vertical support 420 has been securely screwed into ground 440, then wood splitting can commence. Fifth embodiment 400 is used to split wood in the same manner as described above with embodiments 10, 100, 200 and 300.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

I claim:

1. A splitting wedge, comprising:

a) an upwardly facing impact surface;

b) a collar adapted to slidably engage a substantially vertical guide track whereby said wedge moves downwardly along said guide track when struck upon said impact surface; and c) a downwardly facing cutting edge, said cutting edge adapted to cut into an object to be split when said wedge is struck on said impact surface, said wedge configured such that said impact surface is offset towards said collar in relation to said cutting edge whereby the approximate center of said impact surface is closer to said collar than the approximate center of said cutting edge.

2. The splitting wedge as set forth in claim 1 wherein said collar comprises a bore having a substantially vertical axis to slidably engage a tubular guide track.

* * * * *